US008985237B2

(12) United States Patent
Kaufmann

(10) Patent No.: US 8,985,237 B2
(45) Date of Patent: Mar. 24, 2015

(54) POWER SCREWDRIVER

(75) Inventor: Michael Kaufmann, Ellwangen (DE)

(73) Assignee: C. & E. Fein GmbH (DE)

( * ) Notice: Subject to any disclaimer, the term of this patent is extended or adjusted under 35 U.S.C. 154(b) by 547 days.

(21) Appl. No.: 13/163,380

(22) Filed: Jun. 17, 2011

(65) Prior Publication Data

US 2011/0308827 A1 Dec. 22, 2011

(30) Foreign Application Priority Data

Jun. 18, 2010 (DE) ..... 10 2010 024 920

(51) Int. Cl.
*B25B 21/00* (2006.01)
*B25B 23/14* (2006.01)
*B25B 23/147* (2006.01)

(52) U.S. Cl.
CPC ..... *B25B 23/14* (2013.01); *B25B 21/00* (2013.01); *B25B 23/147* (2013.01)
USPC ..... 173/181; 173/179

(58) Field of Classification Search
CPC ..... B25B 23/14; B25B 23/147; B25B 21/00; B23P 19/066
USPC ..... 173/2, 5, 176, 178, 179, 181, 217
See application file for complete search history.

(56) References Cited

U.S. PATENT DOCUMENTS 5,215,270 A * 6/1993 Udocon et al. ..... 29/407.02
5,285,857 A * 2/1994 Shimada ..... 173/1
5,519,604 A * 5/1996 Hansson ..... 700/28
5,637,968 A * 6/1997 Kainec et al. ..... 318/432
7,770,658 B2 * 8/2010 Ito et al. ..... 173/1
8,025,106 B2 * 9/2011 Schmidt ..... 173/1
2010/0059240 A1 * 3/2010 Schmidt ..... 173/1

FOREIGN PATENT DOCUMENTS

DE 4437944 A1 4/1995
DE 102008033866 A1 1/2010
EP 0642891 A1 3/1995
EP 1785231 A2 * 5/2007 ..... B25B 21/00
WO 2007118577 A1 10/2007

* cited by examiner

*Primary Examiner* — Andrew M Tecco
(74) *Attorney, Agent, or Firm* — St. Onge Steward Johnston & Reens LLC

(57) ABSTRACT

A power screwdriver is disclosed, having a drive for driving a tool spindle having a controller for controlling the drive, having a monitoring device for monitoring the rotation speed or the torque, and having a monitoring device for monitoring a switch-off criterion, which monitoring device is coupled to the controller, in order to switch off the drive when the switch-off criterion is reached, with the controller being programmed such that (a) the drive is first of all accelerated until the rotation speed has reached a specific first rotation speed; (b) if the rotation speed then falls by at least a specific amount within a specific time increment, or the torque rises by at least a specific amount within a specific time increment, the drive is braked until the rotation speed has reached a specific second rotation speed, which is lower than the first rotation speed; (c) the drive is then regulated at the second rotation speed for a specific time; and (d) after step (c), the drive is accelerated again at most until the rotation speed reaches the first rotation speed.

11 Claims, 5 Drawing Sheets

POWER SCREWDRIVER

CROSSREFERENCES TO RELATED APPLICATIONS

This application claims convention priority of German patent application Serial No. 10 2010 024 920.3 filed on Jun. 18, 2010, the subject matter of which is fully incorporated herein by reference.

BACKGROUND OF THE INVENTION

The invention relates to a power screwdriver having a drive for a tool spindle having a controller for controlling the drive, and having a monitoring device for monitoring the rotation speed or the torque, which monitoring device is coupled to the controller, in order to switch off the drive when the switch-off criterion is reached, with the controller being programmed such that (a) the drive is first of all accelerated until the rotation speed has reached a specific first rotation speed;

(b) the rotation speed then falls by at least a specific amount within a specific time increment, or the torque rises by at least a specific amount within a specific time increment, the drive is braked until the rotation speed has reached a specific second rotation speed, which is lower than the first rotation speed.

A screwdriver such as this is known from EP 1 785 231 A2.

The known screwdriver has a regulating device, by means of which the rotation speed of the motor can be regulated and which reduces the rotation speed when a trigger parameter is reached. In this case, an angular velocity change per unit time is preferably used as the trigger parameter. If it is found that the angular velocity has slowed down, then the rotation speed is reduced, possibly in a plurality of steps, with the intention of ensuring a relatively accurate tightening torque for the screwdriving process. In this case, the aim is for the discrepancy in the tightening torque between hard screwdriving and soft screwdriving to be small. So-called "soft screwdriving" means a screwdriving process in which the torque rises continuously towards the end of the screwdriving process, until the maximum tightening torque is reached. In the case of "hard screwdriving", the torque is in contrast initially relatively low and rises suddenly and sharply towards the end of the screwdriving process.

In one alternative embodiment of the known screwdriver, the rotation speed is reduced to zero after reaching the trigger parameter, the motor is operated in the opposite rotation direction for a specific time, the rotation direction is then once again reversed, and the screwdriving process is completed at a lower rotation speed than the initial rotation speed.

In the case of the already known screwdriver, although a relatively uniform tightening torque is achieved irrespective of the type of screwdriving process, the total time for completing a screwdriving process is relatively long, particularly in the case of soft screwdriving, since a lower rotation speed is always used at the end, and in some cases is reduced even further. When the rotation direction is reversed, the total time for completing the screwdriving process is increased even further.

DE 10 2008 033 866 A1 discloses a further screwdriver, in which a limiting device is provided in order to limit an output torque, which is produced on the output drive side of the drive train, to a maximum torque value, with the limiting device being designed to operate a current-flow device, which passes current through the drive motor, in a braking mode, by the current-flow device producing a rotating field which brakes the drive motor and is in the opposite sense to the respective rotation direction of the drive motor. Rotation energy in the drive train is taken into account in this case.

This device is intended in particular to make it possible to avoid excessive tightening during hard screwdriving.

Said control for the screwdriver is relatively complicated and actually does not ensure, for any application, that the tightening torque is maintained precisely irrespective of the type of screwdriving process, while at the same time completing the screwdriving process in as short a time as possible.

SUMMARY OF THE INVENTION

According to one aspect a power screwdriver shall be disclosed which ensures rapid completion of a screwdriving process.

According to another aspect a power screwdriver shall be disclosed which provides for a relative precise tightening torque, preferably irrespective of the type of screwdriving process.

According to another aspect a method for controlling a power screwdriver shall be disclosed which allows a screwdriving process to be completed rapidly and precisely, preferably irrespective of the type of screwdriving process.

According to the invention these and other objects are achieved by a method of controlling a power screwdriver having a drive for driving a tool spindle, wherein said method comprises the following steps:

(a) monitoring a rotation speed of said tool spindle;

(b) monitoring a switch-off criterion;

(c) accelerating said drive until the rotation speed reaches a first rotation speed;

(d) if the rotation speed falls by at least a specific amount within a specific time increment, or if a torque transmitted by said drive rises by at least a specific amount within a specific time increment, braking said drive to a second rotation speed, which is lower than said first rotation speed;

(e) controlling said drive at said second rotation speed for a specific time;

(f) accelerating said drive to at most said first rotation speed; and (g) switching off said drive when said switch-off criterion is reached.

According to another aspect of the invention these and other objects are achieved by a power screwdriver comprising:

a drive for driving a tool spindle;

a controller for controlling said drive;

a first sensor for monitoring a rotation speed or a torque; and a second sensor for monitoring a switch-off criterion, said second sensor being coupled to said controller for switching off said drive when said switch-off criterion is reached, wherein said controller is programmed such that (a) said drive is first of all accelerated until said rotation speed has reached a specific first rotation speed;

(b) if said rotation speed then falls by at least a specific amount within a specific time increment, or said torque rises by at least a specific amount within a specific time increment, said drive is braked until said rotation speed has reached a specific second rotation speed, which is lower than said first rotation speed;

(c) said drive is then controlled at said second rotation speed for a specific time;

(d) after step (c), said drive is accelerated again at most until said rotation speed reaches said first rotation speed.

The object of the invention is achieved in this way.

The continuous monitoring of the rotation speed and/or of the torque, in order to detect a rotation speed drop or an increase in the torque, respectively, timely braking of the drive is ensured in order to avoid excessive tightening of the screw connection even during hard screwdriving, in the event of a rapid rotation speed drop or a major increase in the torque. On the other hand, once the drive has been braked to a lower rotation speed after identification of a rotation speed drop, and has then been stopped and subsequently accelerated again, this allows rapid tightening of the screw connection even in the case of soft screwdriving and a brief rotation speed drop, for example as a result of dirt on the thread. At the same time, the continuous monitoring of the switch-off criterion, with the drive being switched off immediately when the switch-off criterion is reached, ensures a precise tightening torque irrespective of the type of screwdriving process.

"Braking" means slowing down the rotation speed of the drive. In this case, this may be active braking, for example by means of self-excited or externally excited short-circuit braking, as is known in principle from the prior art. Alternatively, the braking may also comprise simply disconnection of the drive energy or a reduction in the phase angle in the case of pulse-width modulation control.

Monitoring is preferably once again carried out during the acceleration to determine whether the rotation speed has fallen by a specific amount within a specific time increment during the acceleration or whether the torque has risen by a specific amount within a specific time increment and, if this criterion is satisfied, the drive is braked until the rotation speed has reached the second rotation speed, which is lower than the first rotation speed.

Monitoring is therefore once again carried out during the acceleration process itself to determine whether the criterion for braking the drive is satisfied. For example, in the situation in which the rotation speed has fallen as a result of a fault, for example because of a thread fault or because of dirt, the rotation speed is also still monitored to determine whether it is possible to react quickly if a rotation speed drop occurs so as to prevent excessive tightening of the screw connection in each case.

In a further advantageous refinement of the invention, the switch-off criterion is to monitor whether the tightening torque for screwdriving reaches a specific preset value.

This monitoring of the switch-off criterion is carried out in parallel with the other described processes. For example, for this purpose, the reaching of the switch-off criterion is checked at specific time intervals, for example every 5 milliseconds, thus ensuring that the drive is switched off whenever the switch-off criterion is reached, in order in this way to ensure precise compliance with a predetermined tightening torque of the screw connection.

In a further advantageous refinement of the invention, the drive has a disconnecting clutch, which releases when the preset tightening torque is reached.

This allows a specific tightening torque to be maintained in a particularly precise manner.

In one advantageous development of this embodiment, when the disconnecting clutch is released, the drive is operated at full power.

This assists precise release of the disconnecting clutch since, particularly when the rechargeable battery is virtually drained in the case of a screwdriver powered by a rechargeable battery, this nevertheless ensures that the mechanical disconnecting clutch is released precisely, even when the rotation speed is low.

Furthermore, the drive preferably has a switch-off device for switching off the drive, which switch-off device releases when the preset tightening torque is reached.

This prevents the drive from continuing to run after the disconnecting clutch has been released.

In a further advantageous refinement of the invention, the drive is switched off with a specific time delay after release of the disconnecting clutch.

This ensures defined conditions when the screwdriver is next started, in particular for the disconnecting clutch.

The screwdriver according to the invention has a monitoring device for monitoring the rotation speed or the torque. By way of example, this may be a rotation speed sensor for monitoring the rotation speed of the drive or of the tool spindle, or a torque sensor for monitoring the torque of the drive or of the tool spindle, for example in the form of a strain gauge or a torsion sensor.

In a further advantageous refinement of the invention, in step (b), the instantaneous rotation speed is compared with a plurality of rotation speed values at various times in the past, and the drive is braked if the instantaneous rotation speed has in each case fallen by at least a specific rotation speed difference in comparison to the rotation speed value at least one of the previous times.

This ensures rapid detection of hard screwdriving, since a major rotation speed drop takes place within a short time. In the case of soft screwdriving, a rotation speed drop is detected only after a relatively long time since, in this case, the rotation speed drop is not as great as that in the case of hard screwdriving. However, one advantage is that the rotation speed is always reduced at the correct time, before release of the disconnecting clutch. In terms of the head of the screw making contact, this is very early in the case of hard screwdriving, and is somewhat later in the case of soft screwdriving. This minimizes the time for screwdriving, and increases the accuracy.

It is self-evident that the features mentioned above and those which are still to be explained in the following text can be used not only in the respectively stated combination but also in other combinations or on their own, without departing from the scope of the present invention.

BRIEF DESCRIPTION OF THE DRAWINGS

Further features and advantages of the invention will become evident from the following description of preferred exemplary embodiments with reference to the drawing, in which.

DESCRIPTION OF PREFERRED EMBODIMENTS

Figure 1:
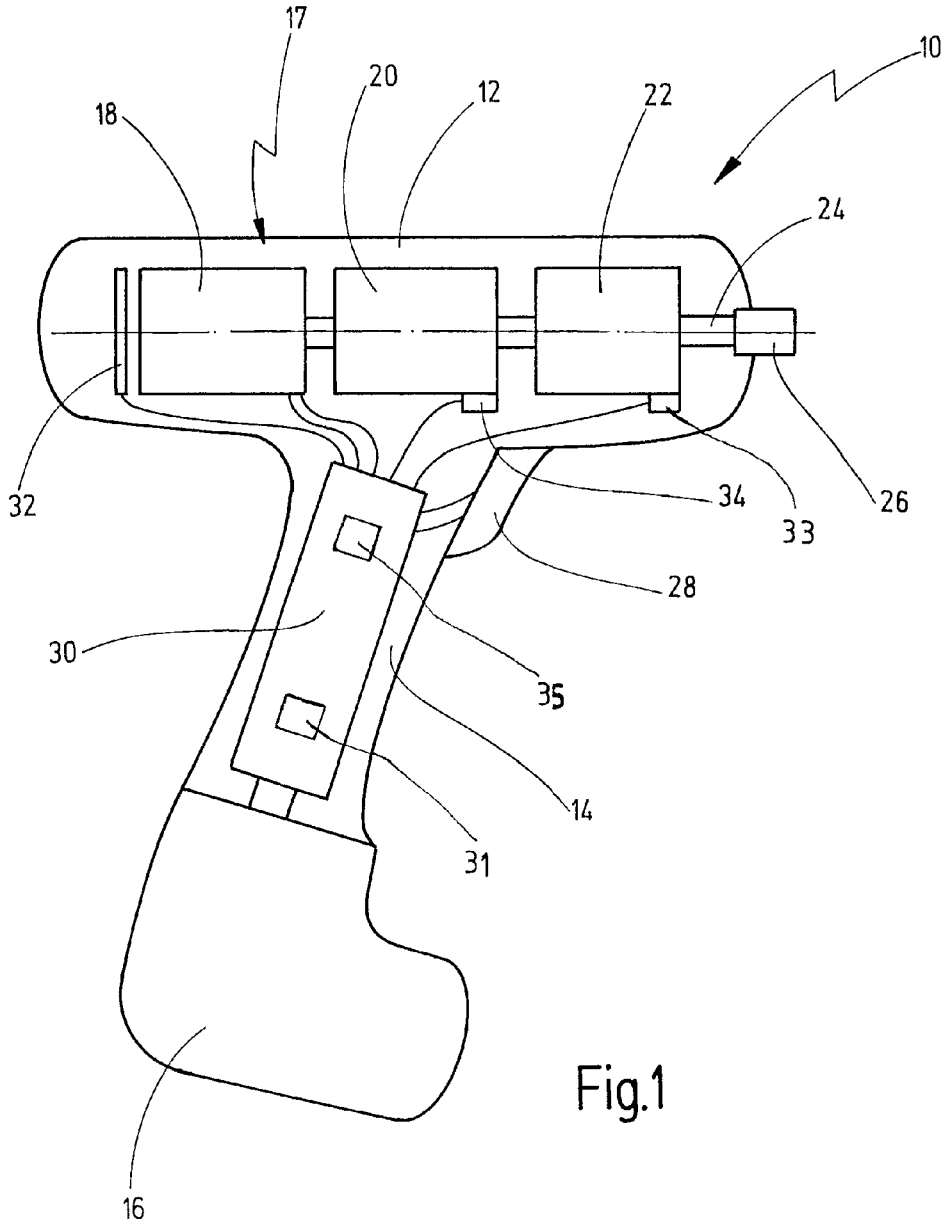
FIG. 1 shows a highly simplified, schematic illustration of a screwdriver according to the invention.

FIG. 1 schematically illustrates a screwdriver according to the invention, which is annotated overall with the reference number 10.

The screwdriver 10 has a housing 12 which is in the form of a pistol and at whose lower end a rechargeable battery packet 16 is held such that it can be replaced. The housing 12 has a handle 14 on which the screwdriver 10 is held, and which can be switched on and off by means of a switching button 28.

A motor 18, a gearbox 20 and a disconnecting clutch 22 are held one after the other in the upper area of the housing 12, and together form the drive 17. The output side of the disconnecting clutch 22 is connected to a tool spindle 24, on which a tool holder 26 is provided for holding a tool, for example a bit. The motor 18 drives the gearbox 20. Finally, the gearbox 20 is coupled to the tool spindle 24 via the disconnecting clutch 22.

The screwdriver 10 is controlled via a central controller 30, which is held in the handle 14 and is connected via suitable lines to the rechargeable battery pack 16, to the switching button 28, to the motor 18, to the gearbox 20 and to the disconnecting clutch 22.

A rotation speed sensor 32 is also provided on the motor 18, for example in the form of a Hall element, and is likewise coupled to the controller 30 via suitable lines.

As is known by way of example from EP 0 320 723 A2, which is included in its entirety by reference here, the gearbox 20 may be in the form of a planetary gearbox, and may be provided with a torque switch-off. When a specific torque is reached, a switch 34, which is coupled to the gearbox 20, is operated via a rotating fork and leads to the motor 18 being switched off. A torsion spring bar can be provided in order to produce a resetting force. As soon as the torque exceeds a preset torque value, the resetting force of the torsion spring bar is overcome, and the switching fork is rotated, leading to operation of the switch 34.

Alternatively or additionally, the disconnecting clutch 22 can be provided, via which the connection between the tool spindle 24 and the gearbox 20 is released, by disengaging the disconnecting clutch 22, when a predetermined torque is reached. Disconnecting clutches such as these have been known for a long time in the prior art, in which context reference is made, by way of example, to EP 0 990 488 A2, which is included in its entirety by reference here.

As an alternative to monitoring the torque at the gearbox 20 by means of the switch 34 which can be released as a function of the torque, the disconnecting clutch 22 can be monitored, and a disengagement movement of the clutch halves can be registered and this can in turn be used, for example mechanically, to operate a switch.

As a further alternative the motor 18, the gearbox 20, or the tool spindle 24 may comprise a torque sensor shown at 33 for monitoring the torque transmitted onto the tool spindle 24. The torque sensor 33 may be a strain sensor.

The rotation speed of the motor 18 is controlled digitally or in analogue form via the controller 30. The controller 30 is preferably a microcontroller and comprises a storage shown at 31 for storing a program code and for storing other data, such as parameters as well as values detected by the sensors 32 and 33. The controller 30 further includes a comparator exemplified at 35, for executing comparing steps. It is needless to say that the controller 30 may comprise also additional external components or that the components mentioned above, such as the storage 31 and the comparator 33 may be integrated within the controller 30.

The rotation speed sensor 32 is provided for rotation speed monitoring and emits a pulse on each revolution of the motor shaft, which pulse is supplied to a counter in the controller 30. If the number of pulses emitted from the sensor per unit time is the same, then the rotation speed n of the motor 18 is constant. If the number of pulses per unit time increases, then the rotation speed n has risen while, if it decreases per unit time, then the rotation speed n has fallen. The number of pulses per unit time is used as an actual variable or input variable by the controller 30. The screwdriver 10 is operated with a load-dependent motor characteristic.

The controller according to the invention for the screwdriver 10 will be explained in more detail in the following text with reference to the two flowcharts shown in FIG. 2*a*) and FIG. 2*b*).

Figures 2A, 2B:
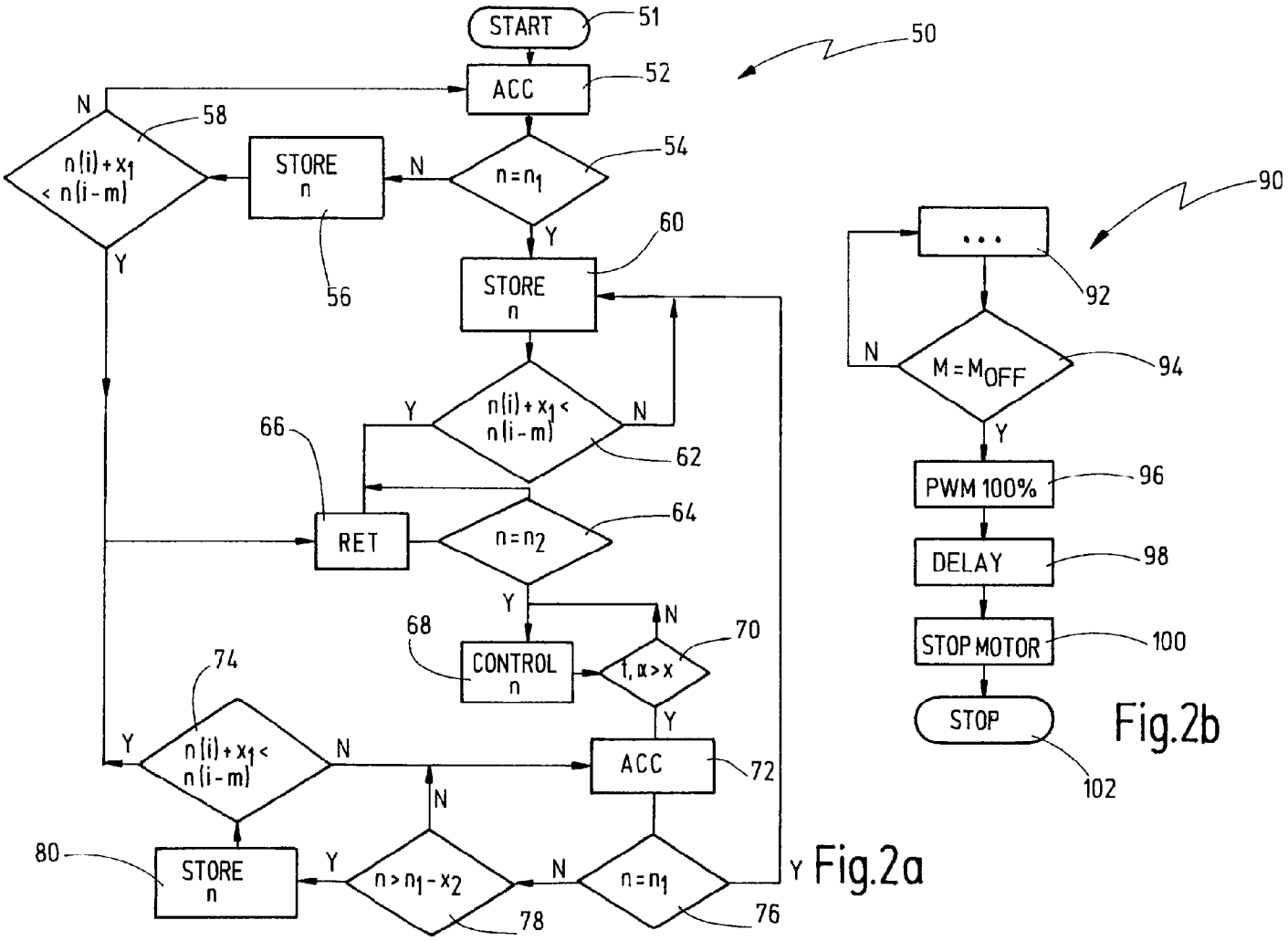
FIG. 2*a*) shows a flowchart for a screwdriving process according to the invention.
FIG. 2*b*) shows a flowchart for the monitoring of the switch-off criterion, which is passed through continuously, in addition, while passing through the flowchart shown in FIG. 5*a*)

FIG. 2*a*) shows a flowchart 50 which illustrates a part of the procedure for the controller 30.

The rotation speed n is measured or calculated at specific times, and the values are stored in a ring memory. By way of example, the rotation speed can be measured every millisecond.

In addition to passing through the flowchart 50 as shown in FIG. 2*a*), a switch-off criterion is continuously monitored, in the course of a separate flowchart 90, which is illustrated separately in FIG. 2*b*), that is integrated in the flowchart shown in FIG. 2*a*) and is checked regularly, for example every five milliseconds, in order to switch off the screwdriver 10 as soon as the switch-off criterion is reached.

After a screwdriving process has been started in 51 ("START"), an acceleration process 52 first of all starts ("ACC"). Acceleration continues until the no-load rotation speed $n_1$ is reached. The acceleration process 52 is designed such that it is as convenient as possible for the user, that is to say smooth starting is carried out. This also prevents high current surges during starting.

A check is now carried out at 54 to determine whether the low-load rotation speed $n_1$ has been reached ("$n=n_1$").

If this is not the case, then the instantaneous rotation speed value n is stored in the next step 56 ("STORE n").

In the next step 58, the instantaneous rotation speed value n(i) is compared with a previous rotation speed value n(i−m). If the instantaneous rotation speed n(i) is less by a specific value $x_1$ than the comparison value, then this indicates a specific rotation speed drop, and the screwdriver 10 is braked (step 66 "RET"). If this is not the case, then the drive 17 is accelerated further (step 52). If the check 54 finds that the nominal rotation speed has been reached ("$n=n_1$"), then this rotation speed value is stored (step 60 "STORE n").

A check is carried out again in the next step 62 to determine whether the rotation speed has fallen at least by the amount $x_1$ from the previous rotation speed. If this is not the case, the screwdriver 10 is operated further at the same rotation speed $n_1$, that is to say a jump is made back to step 60. In contrast, if it is found in the check 62 that a significant rotation speed drop has occurred ($n(i)+x_1<n(i-m)$), then braking takes place in step 66 ("RET").

In order to cover a wider range of screwdriving hardnesses, the instantaneous rotation speed n(i) is compared not only with one previous rotation speed n(i−m) in the checks 58, 62 and 74. In fact, the instantaneous rotation speed n(i) is compared with a plurality of rotation speeds from different times in the past. Each comparison results in a specific value $x_1$ by which the rotation speed must have fallen for braking to be carried out. Hard screwdriving is therefore detected quickly since, in this case, there is a major rotation speed drop within a short time. In contrast, soft screwdriving is detected only after a longer time since, in this case, the rotation speed drop is not as great in comparison to soft screwdriving, or this assumes a significant value only after a longer time.

One advantage of this method is that the rotation speed is always reduced in good time before the disconnecting device is released (mechanical disconnecting clutch). In the case of hard screwdriving, this is very early with respect to the point at which the screw head makes contact, and it is somewhat later in the case of soft screwdriving. This minimizes the screwdriving time and increases the accuracy.

The braking process mentioned in step 66 is carried out until the rotation speed has fallen to a value $n_2$, which is lower than the low-load rotation speed $n_1$. If the rotation speed $n_2$ has not yet been reached, then deceleration is continued according to step 66. If the rotation speed $n_2$ has been reached, then this is regulated in step 68 ("CONTROL n").

The braking process that has been mentioned can be carried out either by "active braking" or else by simply reducing or removing the power supply.

If the rotation speed $n_2$ has been reached, then this is maintained for a specific time, for example for 30 ms-100 ms, preferably 60 milliseconds, or for a specific rotation angle, as is checked in the check 70. Once the time t has elapsed and/or the rotation angle has been reached, then acceleration takes place once again in step 72 ("ACC").

In this case, the acceleration is carried out until the value $n_1$ is reached again, and this is checked in the check 76. If the low-load rotation speed $n_1$ has been reached again, then the process continues to step 60. If the low-load rotation speed $n_1$ has not yet been reached, then a check is carried out in the checking step 78 to determine whether the instantaneous rotation speed differs from the low-load rotation speed $n_1$ by at least a specific amount $x_2$ ($n>n_1-x_2$). If this is not the case, then acceleration continues in step 72. If the rotation speed has reached the desired value, then the instantaneous rotation speed is stored in step 80 ("STORE n").

A check is once again carried out in the next decision block 74 to determine whether the braking criterion has been reached ($n(i)+x_1<n(i-m)$). If this is the case, then braking is initiated according to step 66. Otherwise, acceleration is continued in step 72.

The flowchart 90 as shown in FIG. 2*b* is superimposed on the flowchart 50 as described above, and is checked regularly, for example every 1 to 30 ms, preferably every 5 milliseconds. Starting from any previous step 92 from the flowchart 50, a check is carried out in the decision block 94 to determine whether the switch-off criterion has been reached.

In the present case, the switch-off criterion is used for checking whether a preset torque has been reached. By way of example, this can be monitored with an appropriate sensor while releasing the disconnecting clutch 22. If there is no disconnecting clutch 22, then this could be checked, for example, by means of a torque sensor (for example strain gauge).

If the switch-off criterion has not been reached, then the process continues with the flowchart 50. If the switch-off criterion has been reached, then the motor power is raised to the maximum level in the next step 96 ("PWM 100%"), that is to say the pulse-width modulation is raised to the maximum. This is worthwhile in conjunction with a disconnecting clutch since, particularly if the rechargeable battery 16 has been virtually drained, a mechanical disconnecting clutch will not be released correctly or not reliably. Correct release is produced by jumping over a stud. This brief full drive for the motor 18 ensures that the disconnecting clutch 22 is released reliably. After a delay step 98 which, for example, lasts for 10 ms-300 ms, preferably 50 ms (or a rotation angle of the disconnecting clutch of 30° to 120°, preferably 100°), the motor is then stopped in step 100 ("STOP motor"). The cycle therefore ends at 102 ("STOP").

The algorithm described above ensures rapid tightening of a screw connection irrespective of the type of screwdriving process, and precise maintenance of the tightening torque.

In the illustrated exemplary embodiment, the rotation speed level for the low-load rotation speed $n_1$ is about 800 to 1500 rpm, preferably about 1000 rpm, while the reduced second rotation speed $n_2$ is in the range from 200 to 400 rpm, preferably about 300 rpm, in each case measured at the disconnecting clutch 22 or tool spindle 24.

A number of applications will be explained in more detail in the following text with reference to FIGS. 3 to 5.

Figure 3:
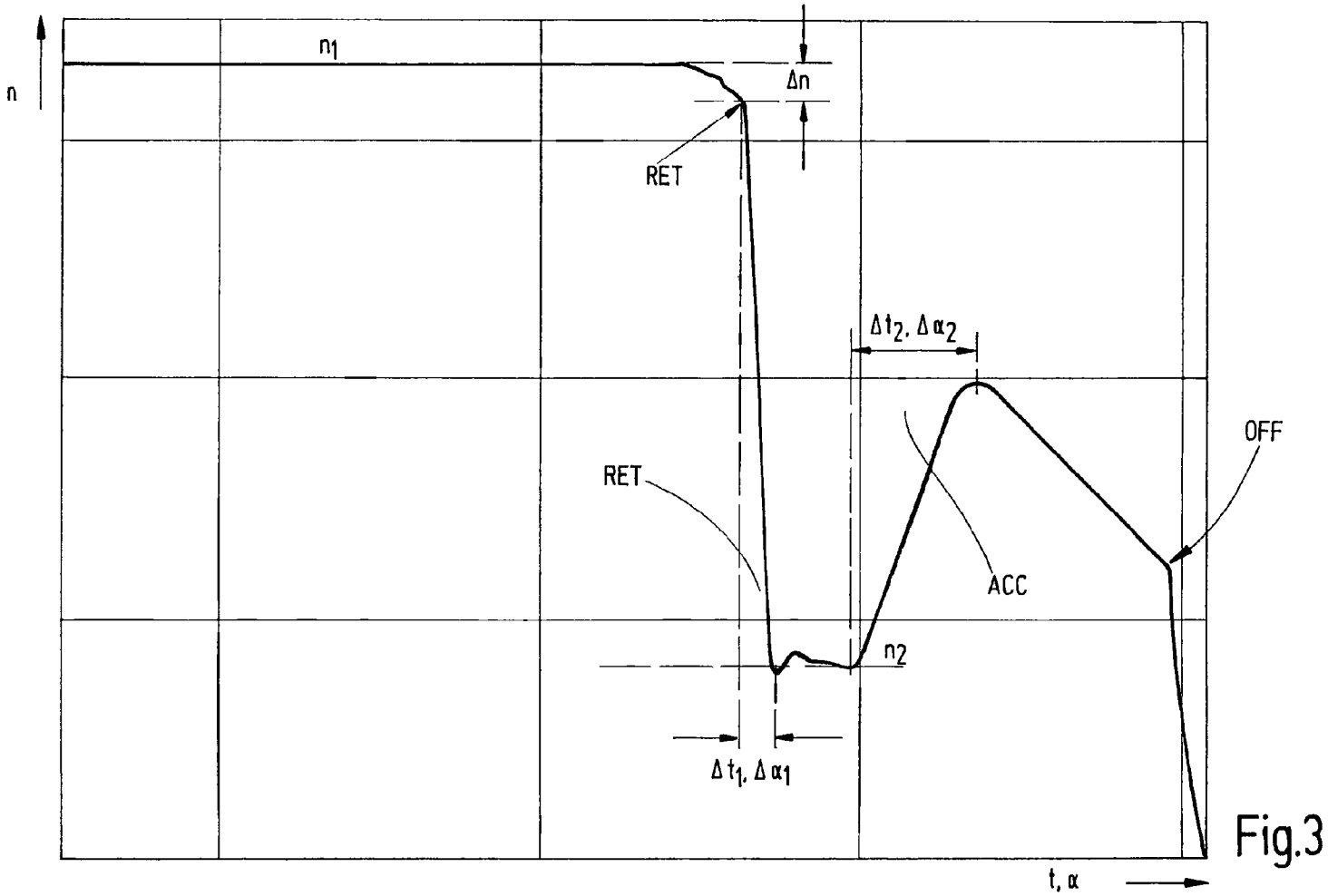
FIG. 3 shows the profile of the rotation speed n over time t, and the rotation angle in the case of soft screwdriving.

FIG. 3 shows use for a soft screwdriving process. The tool spindle 24 is first of all driven at the rotation speed $n_1$ (cf. step 60). A rotation speed drop $\Delta n$ is then detected. As soon as this exceeds the predetermined value $x_1$ is step 62, the braking process starts, as is indicated by the arrow "RET". The braking process RET is continued until the rotation speed $n_2$ is reached. This is regulated in step 68 for a specific time period t or for a specific rotation angle. After this time has elapsed, acceleration takes place once again in step 72, to be precise at most up to the rotation speed $n_1$. However, if the rotation speed n is, as before, less than the rotation speed $n_1$ minus a specific difference $x_2$, then acceleration continues in accordance with the check 78 in step 72. In the illustrated case of soft screwdriving, the rotation speed therefore rises gradually during the final tightening of the screw connection until a natural drop in the rotation speed occurs because of the increasing tightening torque. At the point "OFF", the switch-off criterion according to the decision block 94 is reached. This means the disconnecting clutch releases, and the procedure shown in steps 96, 98, 100, 102 is passed through, until the motor 18 is switched off and the screwdriving process is ended.

Figure 4:
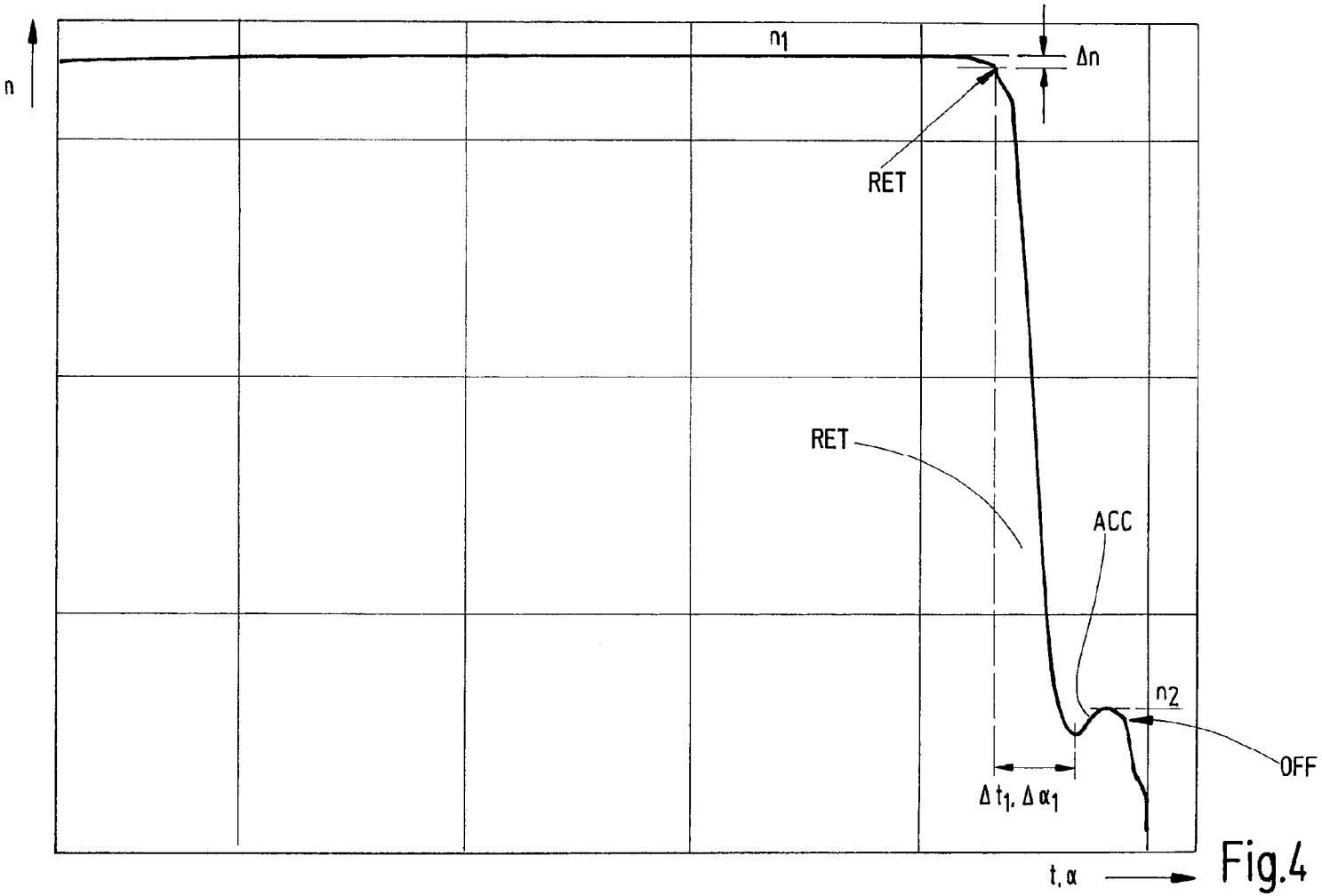
FIG. 4 shows the profile of the rotation speed n over time t, and the rotation angle in the case of hard screwdriving.

FIG. 4 illustrates hard screwdriving.

After the start 51, acceleration first of all takes place, in accordance with step 52, up to the low-load rotation speed $n_1$, and the rotation speed value is then stored in step 60. If the subsequent check in step 62 finds that the rotation speed falls by a specific amount within a specific time, as is indicated by $\Delta n$ in FIG. 4 or $n(i)+x_1<n(i-m)$ in FIG. 2, then the braking according to step 66 is initiated, as is indicated by the arrow "RET" in FIG. 4. The braking process is continued until, finally, the rotation speed $n_2$ is reached or undershot, and regulation takes place in accordance with step 68. Acceleration then starts again, in accordance with step 70, after the predetermined time has elapsed until, finally, the switch-off criterion in step 94 is reached, and the switching-off process is initiated via steps 96, 98, 100, 102, as shown in FIG. 2*b*), at the point indicated by the arrow "OFF" in FIG. 4.

Figure 5:
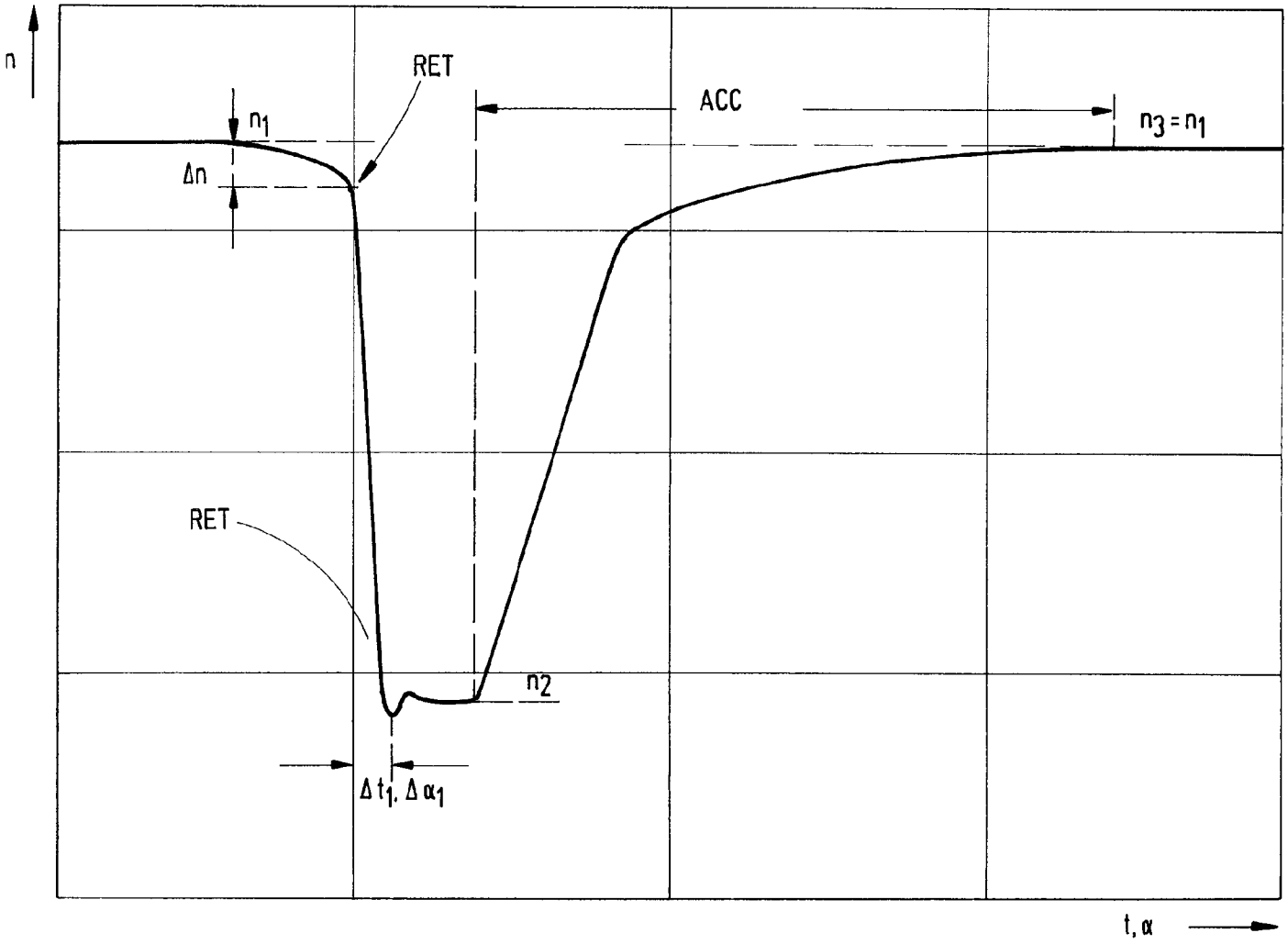
FIG. 5 shows the profile of the rotation speed n over time t and the rotation angle in the event of braking as a result of a fault, because of a brief increase in the torque, for example as a result of a thread fault, with subsequent acceleration.

Finally, FIG. 5 shows a further situation in which a rotation speed drop is first of all detected during the tightening process and leads to braking, but followed by acceleration to the low-load rotation speed $n_1$ again. By way of example, this could occur because of a faulty thread, thus resulting in an increased torque, and therefore a rotation speed drop, briefly during the tightening process, which, however, is overcome again after a short time.

After the start 51 and the acceleration 52, the low-load rotation speed $n_1$ is initially maintained (step 54). During the next checking step 62, a rotation speed drop $\Delta n$ is found, which exceeds the value $x_1$ at a specific time, thus initiating braking according to step 66, as is indicated by the arrow "RET" in FIG. 5. The braking is continued until, finally, the rotation speed $n_2$ is reached or undershot, and regulation is carried out in accordance with step 68, until a predetermined time t has elapsed or a predetermined rotation angle has been overshot. Acceleration "ACC" is then carried out once again in accordance with step 72 until, finally, the low-load rotation speed $n_1$ is reached again, followed by hard or soft screwdriving.

In contrast to the already known screwdriver according to EP 1 785 231 A2, the rotation speed is not reduced to zero throughout the entire regulation process, even with a brief drive in the opposite rotation sense, before acceleration is carried out once again. In fact, according to the invention, when braking occurs, the rotation speed is only reduced to a predetermined positive rotation speed value $n_2$ before acceleration either takes place again, or the process is switched off.

What is claimed is:

1. A power screwdriver comprising:

a drive for driving a tool spindle;

a controller for controlling said drive;

a first sensor for monitoring a rotation speed or a torque; and a second sensor for monitoring a switch-off criterion, said second sensor being coupled to said controller for switching off said drive when said switch-off criterion is reached, wherein said controller is programmed such that when fastening one screw connection:

(a) said drive is first of all accelerated until said rotation speed has reached a specific first rotation speed;

(b) if said rotation speed then falls by at least a specific amount within a specific time increment, or said torque rises by at least a specific amount within a specific time increment, said drive is braked until said rotation speed has reached a specific second rotation speed, which is lower than said first rotation speed;

(c) after step (b), said drive is then controlled at said second rotation speed for a specific time;

(d) after step (c), said drive is accelerated again at most until said rotation speed reaches said first rotation speed.

2. The power screwdriver of claim 1, wherein said controller is configured for monitoring whether the rotation speed has fallen by a specific amount within a specific time increment during said acceleration or whether said torque has risen by a specific amount within a specific time increment and said controller, upon detecting such criterion, is configured for braking said drive until said rotation speed has reached said second rotation speed, which is lower than said first rotation speed.

3. The power screwdriver of claim 1, wherein said drive further comprises a switch-off device for switching off said drive upon reaching said switch-off criterion.

4. The power screwdriver of claim 1, further comprising a torque sensor for monitoring torque transmitted by said drive or by said tool spindle.

5. The power screwdriver of claim 4, wherein said controller is configured for switching off said drive when said torque detected by said torque sensor reaches a specific preset value.

6. The power screwdriver of claim 1, wherein said drive further comprises a disconnecting clutch, which releases when a preset tightening torque is reached.

7. The power screwdriver of claim 1, wherein said drive further comprises a switch-off device for switching off said drive, wherein switch-off device releases when said preset tightening torque is reached.

8. The power screwdriver of claim 1, wherein said controller is configured for monitoring whether the rotation speed has fallen by a specific amount within a specific time increment during the acceleration or whether a torque transmitted by said drive or by said tool spindle has risen by a specific amount within a specific time increment, and said controller, upon detecting such criterion, is configured for braking said drive to said specific second rotation speed, which is lower than said first rotation speed.

9. The power screwdriver of claim 1, wherein said controller comprises a storage which is configured for storing specific rotation speed values detected at specific consecutive times by said first sensor, and further comprises a comparator for comparing the latest rotation speed value detected with a plurality of the stored specific rotation speed values at various times in the past, and wherein said controller is configured for braking said drive upon detecting that the latest rotation speed value has fallen at least by a specific rotation speed difference in comparison to at least one of the stored specific rotation speed values.

10. The power screwdriver of claim 4, wherein said controller comprises a storage which is configured for storing specific torque values detected by said torque sensor at specific consecutive times, and further comprises a comparator for comparing the latest torque value detected with a plurality of the stored specific torque values at various times in the past, and wherein said controller is configured for braking said drive upon detecting that the latest torque value has risen at least by a specific torque difference in comparison to at least one of the stored specific torque values.

11. The power screwdriver of claim 1, further comprising a brake configured for actively braking said drive.

* * * * *